US011559706B2

(12) United States Patent
Lee et al.

(10) Patent No.: US 11,559,706 B2
(45) Date of Patent: Jan. 24, 2023

(54) WORK SAFETY MANAGEMENT SYSTEM USING SAFETY BELT UNIT FOR HIGH-PLACE WORK

(71) Applicant: GSIL CO., LTD., Seongnam-si (KR)

(72) Inventors: Jung Woo Lee, Seoul (KR); Yong Suk Kang, Seongnam-si (KR)

(73) Assignee: GSIL CO., LTD., Seongnam-si (KR)

( * ) Notice: Subject to any disclaimer, the term of this patent is extended or adjusted under 35 U.S.C. 154(b) by 0 days.

(21) Appl. No.: 17/269,087

(22) PCT Filed: May 28, 2019

(86) PCT No.: PCT/KR2019/006384
§ 371 (c)(1),
(2) Date: Feb. 17, 2021

(87) PCT Pub. No.: WO2020/040409
PCT Pub. Date: Feb. 27, 2020

(65) Prior Publication Data

US 2021/0248892 A1 Aug. 12, 2021

(30) Foreign Application Priority Data

Aug. 22, 2018 (KR) ..... 10-2018-0097779

(51) Int. Cl.
*A62B 1/16* (2006.01)
*A62B 35/00* (2006.01)
(Continued)

(52) U.S. Cl.
CPC ..... *A62B 1/16* (2013.01); *A62B 1/04* (2013.01); *A62B 35/0025* (2013.01);
(Continued)

(58) Field of Classification Search
CPC .... G08B 21/00; G08B 21/02; G08B 21/0277; G08B 21/04; G08B 21/0438; A62B 1/00;
(Continued)

(56) References Cited

U.S. PATENT DOCUMENTS

2005/0194211 A1* 9/2005 O'Shall ..... A62B 35/0025 182/3
2012/0012421 A1* 1/2012 Morgan ..... A62B 35/0018 182/3
(Continued)

FOREIGN PATENT DOCUMENTS

JP 2017-093515 A 6/2017
KR 10-2014-0079069 A 6/2014
(Continued)

OTHER PUBLICATIONS

NPL Search (Feb. 19, 2022).*
(Continued)

*Primary Examiner* — Van T Trieu
(74) *Attorney, Agent, or Firm* — Knobbe Martens Olson & Bear LLP

(57) ABSTRACT

The present disclosure relates to a work safety management system using a safety belt unit for high-place work, and safety during working at a high place can be enhanced by determining whether a worker has fastened a seat belt to a safety structure, and the location of the worker, whether the seat belt is fastened and whether the work is on progress can be monitored in real time from a remote location to prevent safety accidents.

3 Claims, 4 Drawing Sheets

(51) Int. Cl.

| | |
|---|---|
| ***E04G 21/32*** | (2006.01) |
| ***G08B 21/02*** | (2006.01) |
| ***G08B 21/04*** | (2006.01) |
| ***A62B 1/04*** | (2006.01) |

(52) U.S. Cl.
CPC ..... *E04G 21/3276* (2013.01); *G08B 21/0277* (2013.01); *G08B 21/0438* (2013.01)

(58) Field of Classification Search
CPC .. A62B 1/04; A62B 1/16; A62B 35/00; A62B 35/0018; A62B 35/0025; A62B 35/0075
See application file for complete search history.

(56) References Cited

U.S. PATENT DOCUMENTS

2012/0222912 A1* 9/2012 Wood ..... A62B 1/14 182/6
2018/0289987 A1* 10/2018 Hung ..... A62B 35/0093
2021/0358282 A1* 11/2021 Lin ..... G08B 21/043

FOREIGN PATENT DOCUMENTS

KR 10-2015-0084023 A 7/2015
KR 10-2017-0031899 A 3/2017
KR 10-1790157 B1 10/2017
KR 10-1964727 B1 4/2019
WO WO 2014/068266 A2 5/2014

OTHER PUBLICATIONS

International Search Report and Written Opinion dated Aug. 26, 2019 in International Application No. PCT/KR2019/006384, in 8 pages. (English translation of ISR.).

* cited by examiner

WORK SAFETY MANAGEMENT SYSTEM USING SAFETY BELT UNIT FOR HIGH-PLACE WORK

TECHNICAL HELD

The present disclosure relates to a work safety management system using a seat belt unit for high-place work, and more particularly, to a work safety management system using a seat belt unit for high-place work that may increase safety during work at a high place.

BACKGROUND ART

In general, during working at a high place from the ground, such as a building construction site for constructing high-rise structures such as buildings or bridges, a subway construction site or a water supply and sewage construction site for constructing an underground structure, telephone poles and a steel towers where repair work is performed, workers work on various treadmills and structures installed at a high place. Here, in order to protect the worker from fall accidents during working at such a high place, it is mandatory for the worker to wear safety protective equipment such as a safety swing, a fall prevention safety rope connected to the safety swing, and a hard hat.

In the case of such safety protective equipment, a safety rope with both ends fixed by an outer ring connects the safety belt and a fixed support, and there are often accidents in which workers fall because they do not inadvertently fasten a safety hook.

Conventional safety swings and safety hooks are configured to prevent workers from falling in a simple way that is hung between the safety belt and the fixed support, but there is a problem in that fall accidents occur because workers do not continuously fasten the safety hook due to the work condition that frequently moves even in the high-place work area.

DESCRIPTION OF EMBODIMENTS

Technical Problem

An objective of the present disclosure is to provide a work safety management system using a seat belt unit for high-place work that may increase safety during working at high places by determining whether a worker properly fastens the seat belt to a safety structure during working at a high place.

In addition, another objective of the present disclosure is to provide a work safety management system using a seat belt unit for high-place work that may easily monitor, in real time from a remote location, the position of the worker, whether the seat belt is fastened, and whether the work is progressing and prevent safety accidents.

Solution to Problem

The objective of the present disclosure is achieved by a seat belt unit for high-place work including a safety swing worn on a worker's body; a seat belt having a safety hook attached to a safety structure and a safety strap connecting the safety hook to the safety swing, and supporting the safety swing to the safety structure in a suspension manner; and a fastening detector provided in the safety hook and configured to detect whether the seat belt and the safety structure are fastened.

Here, a seat belt communication module for transmitting data on whether the seat belt is fastened to the safety structure to the external device may be further included, wherein the data is detected by the fastening detector.

A safety hook holder provided in the safety swing and having an attaching and detaching part to which the safety hook is attached and detached may be further included.

A mounting detection part provided in the attaching and detaching part and detecting whether the safety hook of the seat belt is mounted on the safety hook holder may be further included.

A holder communication module for transmitting data on whether the safety hook of the seat belt is mounted on the safety hook holder to the external device may be further included, wherein the data is detected by the mounting detection part.

An indicator provided in the safety hook holder and indicating whether the safety hook of the seat belt is mounted on the safety hook holder to an outside based on the data detected by the mounting detection part may be further included.

An altitude measurement module for measuring the altitude of the safety hook holder may be further included.

A position measurement module for measuring the position and altitude of the safety hook holder may be further included.

Meanwhile, according to another field of the present disclosure, the objective of the present disclosure may be achieved by a work safety management system using a seat belt unit for high-place work including the seat belt unit for high-place work; and a control unit for displaying data on whether the seat belt is fastened to the safety structure through a display unit of the external device, wherein the data is received through the seat belt communication module.

The control unit may display data on whether the safety hook of the seat belt is mounted on the safety hook holder through the display unit of the external device, wherein the data is received through the holder communication module.

The control unit may display data on the altitude of the safety hook holder through the display unit of the external device, wherein the data is received from the altitude measurement module through the holder communication module.

The control unit may display data on the position of the safety hook holder through the display unit of the external device, wherein the data is received from the position measurement module through the holder communication module.

The control unit may be configured to allow the number, position, and altitude of the worker wearing the seat belt unit for high-place work, and the fastening of the seat belt to the safety structure to be displayed through the display unit of the external device. In addition, when the display unit of the external device displays that the seat belt of the worker wearing the seat belt unit for high-place work is not fastened to the safety structure, the control unit may generate a warning through a warning generating unit provided in a corresponding work area and display a warning screen on the display unit of the external device.

Advantageous Effects of Disclosure

According to the present disclosure, safety during working at high places may be increased by determining whether the worker properly fastens the seat belt to the safety structure during work at high places. In addition, the location of the worker, whether the seat belt is fastened, and whether the work is in progress may be easily monitored in real time from a remote location, and safety accidents may be prevented.

MODE OF DISCLOSURE

Figure 1:
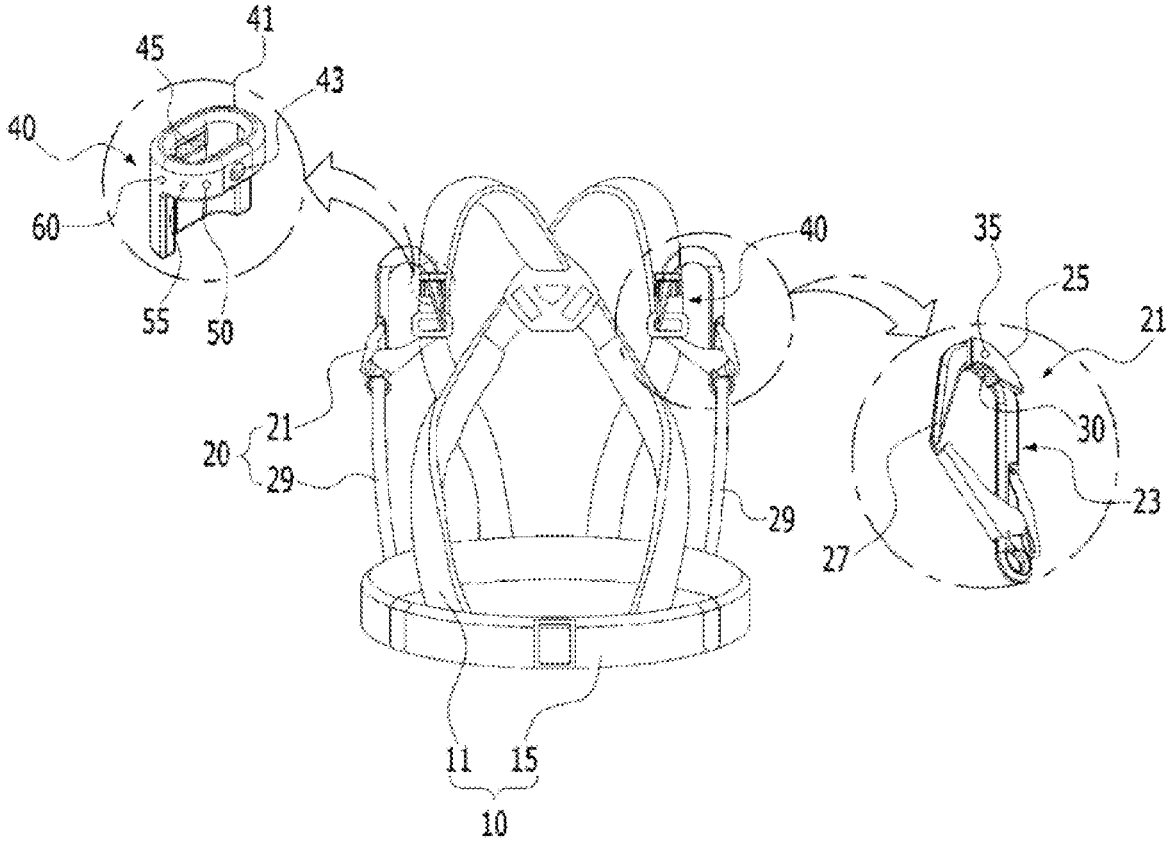
FIG. 1 is a configuration diagram of a seat belt unit for high-place work according to an embodiment of the present disclosure.

Advantages and features of the present disclosure, and a method of achieving the same will become apparent with reference to the embodiments described below in detail together with the accompanying drawings. However, the present disclosure is not limited to the embodiments disclosed below, but may be implemented in a variety of different forms, only the present embodiments make the disclosure of the present disclosure complete, and are common in the technical field to which the present disclosure pertains. It is provided to fully inform the technician of the scope of the present disclosure.

The terms used in the present specification are for describing exemplary embodiments and are not intended to limit the present disclosure. In this specification, the singular form also includes the plural form unless specifically stated in the phrase. As used in the specification, "comprises" and/or "comprising" do not exclude the presence or addition of one or more other elements other than the mentioned elements. Throughout the specification, the same reference numerals refer to the same elements, and "and/or" includes each and all combinations of one or more of the mentioned elements. Although "first", "second", and the like are used to describe various elements, it goes without saying that these elements are not limited by these terms. These terms are only used to distinguish one component from another component, Therefore, it goes without saying that the first component mentioned below may be a second component within the spirit of the present disclosure.

Unless otherwise defined, all terms (including technical and scientific terms) used in the present specification may be used with meanings that can be commonly understood by those of ordinary skill in the art to which this disclosure belongs. In addition, terms defined in a commonly used dictionary are not interpreted ideally or excessively unless explicitly defined specifically.

Hereinafter, the present disclosure will be described in detail with reference to the accompanying drawings.

Figure 2A:
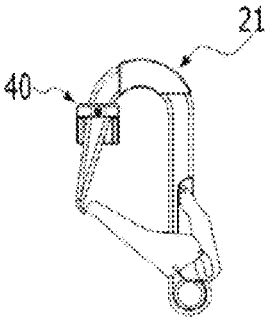
FIG. 2A through FIG. 2C are views illustrating a process of using the seat belt unit for high-place work according to an embodiment of the present disclosure.
Figure 2B:
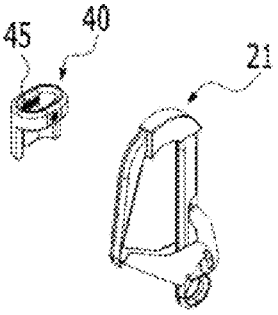
Figure 2C:
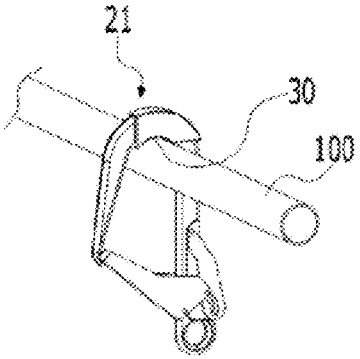

FIGS. 1 through 2C illustrate a seat belt unit for high-place work according to an embodiment of the present disclosure.

As illustrated in these figures, the seat belt unit for high-place work according to an embodiment of the present disclosure includes a safety swing 10, a seat belt 20, and a fastening detector 30.

The safety swing 10 includes a shoulder fixing band 11 that is worn on the shoulder of the worker and arranged in a form in which the left and right bands cross each other and a waist fixing band 15 that is worn on the waist of the worker. Here, although not illustrated, the safety swing 10 may further include a lower body support band connected to the lower end of the shoulder fixing band 11 and worn on the lower body of the worker.

The seat belt 20 includes a safety hook 21 and a safety strap 29.

The safety hook 21 may be a conventional one having an opening and closing member 27 having a structure that is selectively opened and closed by an external force in an opening portion of a body 23 having a non-circular hook shape. However, the present disclosure is not limited thereto, and a snap hook commonly referred to as a carabiner described above may be used, and the type thereof is not particularly limited as long as being able to be attachable to or detachable from the safety structure 100.

In the body 23 of the safety hook 21, a locking portion 25 is formed to be curved so as to be in close contact with the safety structure 100, thereby settling on the safety structure 100.

The safety hook 21 is mounted on one end of the safety strap 29, and the safety swing 10 is connected to the other end of the safety strap. Here, the other end of the safety strap 29 may be integrally coupled with the safety swing 10, or a separate safety hook 21 may be provided to enable the attachment to or detachment from the safety swing 10.

Accordingly, by settling the safety hook 21 on the safety structure 100, the seat belt 20 supports the safety swing 10 with respect to the safety structure 100 in a suspension manner.

The fastening detector 30 is provided on the locking portion 25 of the safety hook 21 and detects whether the seat belt 20 is fastened to the safety structure 100.

Here, a pressure sensor (physical sensor, electronic sensor) may be provided as the fastening detector 30, whereby the pressure generated between the locking portion 25 and the safety structure 100 of the safety hook 21 is measured, and whether the seat belt 20 is fastened to the safety structure 100 may be measured. That is, by detecting the pressure generated when the locking portion 25 of the safety hook 21 is in close contact with the safety structure 100, and it may be confirmed whether the seat belt 20 is hung on the safety structure 100 or not.

In addition, the seat belt unit for high-place work 1 according to an embodiment of the present disclosure may further include a seat belt communication module 35.

The seat belt communication module 35 is provided in the safety hook 21 of the seat belt 20 and transmits, to the external device 80, data which is on whether the seat belt 20 is fastened to the safety structure 180 and which is detected by the fastening detector 30. The seat belt communication module 35 is synchronized to enable data communication with a server and a terminal which are the external device 80.

Meanwhile, an application app that is synchronized with the seat belt communication module 35 may be installed in the external device 80. The application app may include a mobile native application, a mobile web application, and a mobile hybrid application.

Here, although not illustrated, the seat belt 20 may include a rechargeable battery for supplying power to the fastening detector 30 and the seat belt communication module 35, and a charging terminal to which a power source is connected to charge the rechargeable battery.

Meanwhile, the seat belt unit for high-place work 1 according to an embodiment of the present disclosure may further include a safety hook holder 40.

The safety hook holder 40 has a ring shape having a partially cut side, and is mounted on the safety swing 10.

An attaching and detaching part 41 which the safety hook 21 is attached to and detached from is formed in the safety hook holder 40.

A mounting detection part 45 is formed on the inner periphery of the attaching and detaching part 41 to detect whether the safety hook holder 40 and the safety hook 21 of the seat belt 20 are mounted.

A touch sensor may be provided as the mounting detection part 45, whereby it is detected whether the safety hook 21 of the seat belt 20 contacts the touch sensor of the safety hook holder 40. Accordingly, it may be identified whether the safety hook 21 of the seat belt 20 is mounted on the safety hook holder 40 or not.

In addition, an indicator 43 is provided on the safety hook holder 40.

The indicator 43 is made of an LED lamp that emits light, and indicates, to the outside, whether the safety hook 21 of the seat belt 20 is mounted on the safety hook holder 40, based on the data detected by the mounting detection part 45. For example, the indicator 43 is configured to be turned off when the safety hook 21 of the seat belt 20 is mounted on the safety hook holder 40, and to be turn on when the safety hook 21 of the seat belt 20 is not mounted on the safety hook holder 40.

In addition, the seat belt unit for high-place work 1 according to an embodiment of the present disclosure may further include a holder communication module 50.

The holder communication module 50 is provided in the safety hook 21 of the seat belt 20, and transmits, to the external device 80, the data which is on whether the safety hook 21 of the seat belt 20 is mounted on the safety hook holder 40, and which is detected by the mounting detection part 45. The holder communication module 50 is synchronized to enable data communication with the server and the terminal, which are an example of the external device 80.

In an embodiment, an application app which is synchronized with the holder communication module 50, may be installed in the external device 80. The application app may include a mobile native application, a mobile web application, and a mobile hybrid application.

In addition, an indicator 43 is provided on the outer periphery of the attaching and detaching part 41 of the safety hook holder 40.

The indicator 43 is made of an LED lamp that emits light, and indicates, to the outside, whether the safety hook 21 of the seat belt 20 is mounted on the safety hook holder 40 based on the data detected by the mounting detection part 45. For example, the indicator 43 may be provided to be turned off when the safety hook 21 of the seat belt 20 is mounted on the safety hook holder 40, and to be turn on when the safety hook 21 of the seat belt 20 is not mounted on the safety hook holder 40.

In addition, the seat belt unit for high-place work 1 according to an embodiment of the present disclosure may further include an altitude measurement module 55 and a position measurement module 60.

The altitude measurement module 55 is provided in the safety hook holder 40, and measures the altitude of the safety hook holder 40.

The position measurement module 60 is provided in the safety hook holder 40, and measures the position and altitude of the safety hook holder 40.

Data about the altitude and the location of the safety hook holder 40 measured through the altitude measurement module 55 and the position measurement module 60, respectively, may be transmitted to the external device 80 through the holder communication module 50.

Here, although not illustrated, the safety hook holder 40 may include a rechargeable battery for providing power to the mounting detection part 45, the indicator 43, the holder communication module 50, the altitude measurement module 55, and the position measurement module 60, and a charging terminal to which a power source is connected to charge the rechargeable battery.

Figure 3:
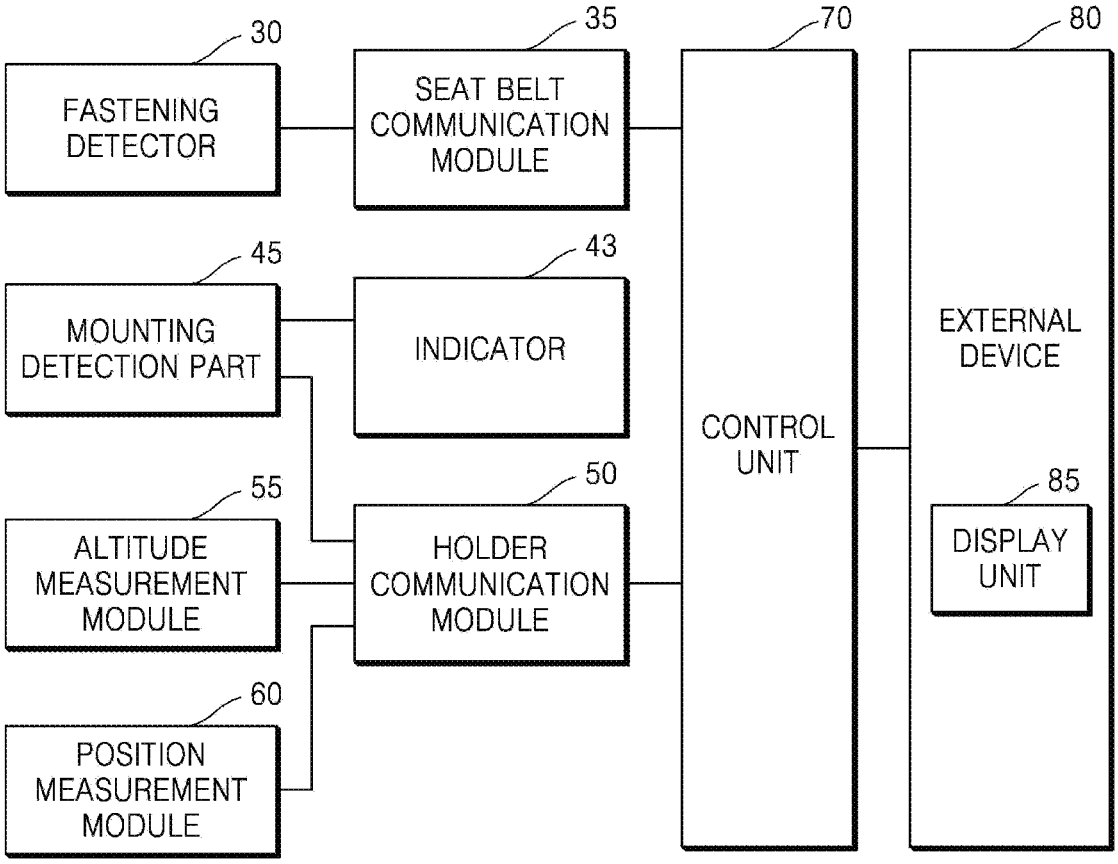
FIG. 3 is a control block diagram of a safety management system using the seat belt unit for high-place work according to an embodiment of the present disclosure.

Meanwhile, as illustrated in FIG. 3, each component of the seat belt unit for high-place work 1 according to an embodiment of the present disclosure described above may constitute a work safety management system together with a control unit 70.

The control unit 70 is provided in the external device 80 such as the server, the terminal, etc., and may control such that data which is on whether the seat belt 20 is fastened to the safety structure 100 and which is received through the seat belt communication module 35, is displayed through a display unit 85 of the external device 80.

In addition, the control unit 70 may control such that data which is on whether the safety hook 21 of the seat belt 20 is mounted on the safety hook holder 40 and which is received through the holder communication module 50, is displayed through the display unit 85 of the external device 80.

In addition, the control unit 70 may control such that data which is on the altitude of the safety hook holder 40 and which is received from the altitude measurement module 55 through the holder communication module 50, is displayed through the display unit 85 of the external device 80.

In addition, the control unit 70 may control such that data which is on the position of the safety hook holder 40 and which is received from the position measurement module 60 through the holder communication module 50, is displayed through the display unit 85 of the external device 80.

With this configuration, the safety swing 10 is mounted on the body of the worker, and at the same time, the safety hook holder 40 is mounted on the safety swing 10. And, as illustrated in FIG. 1 and FIG. 2A, the safety hook 21 of the seat belt 20 is mounted on the safety hook holder 40. At this time, the mounting detection part 45 detects that the safety hook 21 of the seat belt 20 is mounted on the safety hook holder 40, and transmits corresponding data to the control unit 70 through the holder communication module 50.

Subsequently, the worker moves to a high-place workplace. At this time, the altitude and position of the worker are measured through the altitude measurement module 55 and the position measurement module 60, respectively, and transmitted to the control unit 70 through the holder communication module 50.

And, as illustrated in FIG. 23, for work at a high place, the safety hook 21 of the seat belt 20 is separated from the safety hook holder 40. At this time, the mounting detection part 45 detects that the safety hook 21 of the seat belt 20 is separated from the safety hook holder 40, and transmits corresponding data to the control unit 70 through the holder communication module 50.

Subsequently, the safety hook 21 of the seat belt 20 is fastened to the safety structure 100, as shown in FIG. 2C. At this time, the fastening detector 30 detects that the safety hook 21 of the seat belt 20 is fastened to the safety structure 100, and transmits corresponding data to the control unit 70 through the seat belt communication module 35.

And, the worker may work in a state in which the safety hook 21 of the seat belt 20 is fastened to the safety structure 100.

Meanwhile, the control unit 70 manages a plurality of workers wearing the seat belt unit for high-place work. That is, the control unit 70 may display, through the display unit 85 of the external device 80, the number, position, altitude of the worker wearing the seat belt unit for high-place work 1, and whether the seat belt 20 is fastened to the safety structure 100, In addition, when it is displayed on the display unit 85 of the external device 80 that the seat belt 20 of the worker wearing the seat belt unit for high-place work 1 has not been fastened to the safety structure 100, the control unit may generate a warning through a warning generating unit provided in a corresponding work area, and may display a warning screen on the display unit 85 of the external device 80.

Figure 4A:
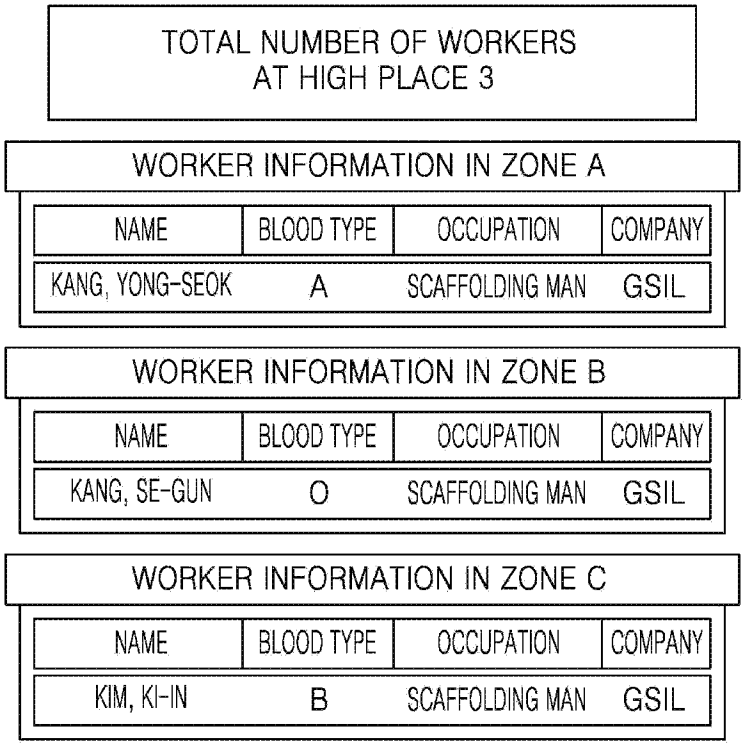
FIG. 4A through FIG. 4C are views illustrating a monitoring screen according to the work safety management system according to an embodiment of the present disclosure.
Figure 4B:
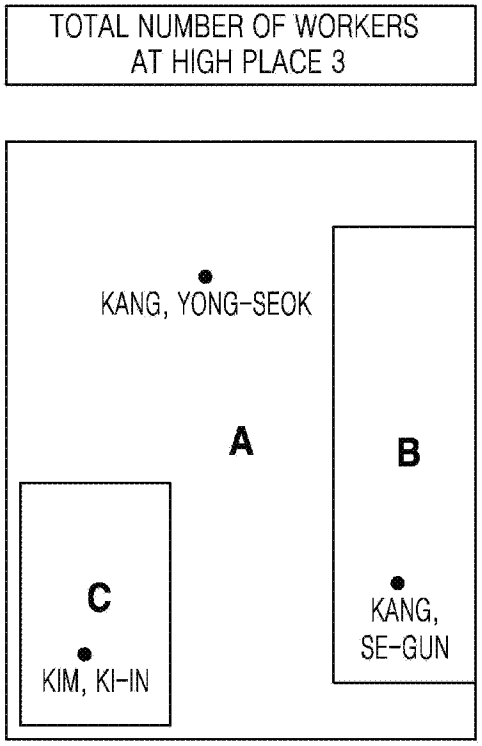
Figure 4C:
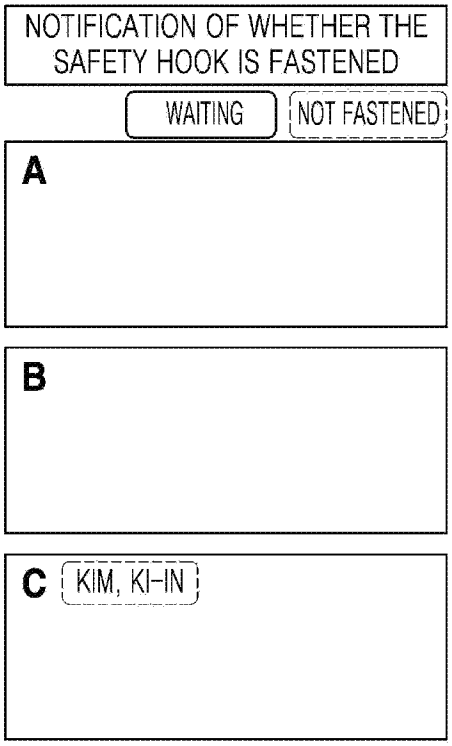

In FIGS. 4A through 4C, as an example, a screen for monitoring the status of a plurality of workers wearing the seat belt unit for high-place work in real time through the display unit 85 of the external device 80 is illustrated.

As illustrated in FIG. 4A and FIG. 4B, the number of workers and work places (areas A, B, and C) of the worker, and information of the worker are displayed through the display unit 85. In addition, during working at a specific altitude or higher, as illustrated in FIG. 4C, whether the safety hook 21 of the worker is fastened, that is, whether the safety hook 21 of the seat belt 20 is fastened to the safety structure 100 may be monitored through the display unit 85, in particular, when the safety hook 21 is not fastened, a warning installed in the corresponding area is generated, and a warning screen is displayed through the display unit 85.

Therefore, through the work safety management system using the seat belt unit for high-place work according to an embodiment of the present disclosure, whether the worker has fastened the safety hook 21 of the seat belt 20 to the safety structure 100 may be determined and monitored in real time through the seat belt communication module 35.

That is, in the work safety management system using the seat belt unit for high-place work according to an embodiment of the present disclosure, signals transmitted from the seat belt unit for high-place work 1 worn by the worker may be detected, data on the location of each area may be collected and the work environment of the worker may be determined through the altitude measurement module 55, the mounting detection part 45, and the position measurement module 60 of the safety hook holder 40, whether the safety hook holder 40 and the safety hook 21 of the seat belt 20 are mounted may be determined through the mounting detection part 45, and whether the seat belt 20 is fastened to the safety structure 100 may be determined through the safety hook 21 of the seat belt 20 and the fastening detector 30.

Accordingly, it is determined whether or not the operator properly fastened the seat belt 20 to the safety structure 100 during working at a high place, so that safety during working at a high place can be improved. In addition, the location of the worker, whether the seat belt 20 is fastened, and whether the work is on progress can be monitored in real time easily from a remote location, so that safety accidents can be prevented.

The invention claimed is:

1. A work safety management system using a safety belt unit for high-place work, comprising:

a safety swing worn on a body of a worker;

a seat belt having a safety hook settling on a safety structure and a safety strap connecting the safety hook to the safety swing, and supporting the safety swing to the safety structure in a suspension manner;

a fastening detector provided in the safety hook and detecting whether the seat belt is fastened to the safety structure;

a safety hook holder provided in the safety swing and having an attaching and detaching part to or from which the safety hook is attached or detached;

a mounting detector provided in the attaching and detaching part to detect whether the safety hook of the seat belt is mounted on the safety hook holder;

a seat belt data transmitter configured to transmit, to an external device, data which is on whether the seat belt is fastened to the safety structure and which is detected by the fastening detector;

a holder data transmitter configured to transmit, to the external device, data which is on whether the safety hook of the seat belt is mounted on the safety hook holder and which is detected by the mounting detector;

an altitude sensor disposed on the safety hook holder and configured to sense an altitude of the safety hook holder;

a position sensor disposed on the safety hook holder and configured to sense a position and altitude of the safety hook holder; and a controller configured to:

display, through a display unit of the external device, data which is on whether the seat belt is fastened to the safety structure and which is received through the seat belt data transmitter, display, through the display unit of the external device, data which is on whether the safety hook of the seat belt is mounted on the safety hook holder and which is received through the holder data transmitter, and display, through the display unit of the external device, data which is on the altitude and position of the safety hook holder and which is received from the altitude sensor and the position sensor through the holder data transmitter.

2. The work safety management system of claim 1, further comprising an indicator provided in the safety hook holder and indicating whether the safety hook of the seat belt is mounted on the safety hook holder to the outside, based on data detected by the mounting detector.

3. The work safety management system of claim 1, wherein the controller is configured to display, through the display unit of the external device, the number, position, altitude of the worker, and whether the seat belt is fastened to the safety structure, and wherein when it is displayed on the display unit of the external device that the worker has not fastened the seat belt to the safety structure, the controller is configured to generate a warning through a warning generator provided in a corresponding work area, and display a warning screen on the display unit of the external device.

* * * * *